United States Patent [19]

Melhus et al.

[11] Patent Number: 4,688,465

[45] Date of Patent: Aug. 25, 1987

[54] METHOD AND APPARATUS FOR PRODUCTION OF CARTRIDGED PROPELLANT CHARGES FOR BARREL WEAPONS

[75] Inventors: Ulf Melhus; Mats Olsson; Nils-Gunnar Björkqvist; Lars-Erik Björn; Dennis Taylor, all of Karlskoga, Sweden

[73] Assignee: Aktiebolaget Bofors, Bofors, Sweden

[21] Appl. No.: 703,572

[22] Filed: Feb. 20, 1985

[30] Foreign Application Priority Data

Feb. 21, 1984 [SE] Sweden ..... 8400924
Jan. 11, 1985 [SE] Sweden ..... 8500118

[51] Int. Cl.[4] ..... F42B 3/00; F42B 33/02; C06D 1/08

[52] U.S. Cl. ..... 86/20.14; 86/20.1; 86/29; 86/30; 86/33; 102/430; 141/73

[58] Field of Search ..... 102/430, 435, 290; 86/17, 19, 20 R, 20 B, 29, 30, 31, 32, 33, 25, 26, 27, 20.1, 20.14; 141/73; 100/226

[56] References Cited

U.S. PATENT DOCUMENTS

| | | | |
|---|---|---|---|
| 294,176 | 2/1884 | Alexander . | |
| 1,518,272 | 12/1924 | Olmstead | 86/29 |
| 2,630,041 | 3/1953 | Perry et al. | 86/30 |
| 2,927,499 | 3/1960 | Mog et al. | 86/31 |
| 2,987,952 | 6/1961 | Hengel | 86/30 |
| 3,464,311 | 9/1969 | Smith | 86/30 |
| 3,796,127 | 3/1974 | Deitemeyer | 86/30 |
| 3,882,784 | 5/1975 | Nauflett et al. | 102/103 |
| 3,893,492 | 7/1975 | Nohren | 86/31 |
| 4,208,945 | 6/1980 | Davegardh et al. | 86/20 R |
| 4,395,934 | 8/1983 | Axelrod et al. | 86/19 |

FOREIGN PATENT DOCUMENTS

| | | | |
|---|---|---|---|
| 0103493 | 3/1938 | Australia | 86/19 |
| 0304948 | 1/1929 | United Kingdom | 86/19 |

*Primary Examiner*—Stephen J. Lechert, Jr.
*Assistant Examiner*—Howard J. Locker
*Attorney, Agent, or Firm*—Pollock, Vande Sande & Priddy

[57] ABSTRACT

The present invention relates to a method and an apparatus for production of cartridged propellant charges for barrel weapons with charge weights up to 1.4 kg/liter.

According to the invention, more granular or particle-shaped propellant powder is driven down or compacted than can be housed in free-running condition within the same volume by means of a piston or plunger (6) in a single stage down into a case (4) the inside of which is coated with a friction-reducing coating. The piston or plunger (6) can then be provided with an elastically deformable leading part (7) of e.g. rubber and/or with a conically tipped leading end (*7a*). According to one variant of the invention the powder is pressed down into a bag (12, 13) of combustible fibre material which has been inserted in advance down into the case (4) coated internally with a friction-reducing coating or which has itself been impregnated with a friction-reducing coating.

The invention also enables the powder to be compacted to advantage at a temperature that is higher than the room temperature.

11 Claims, 7 Drawing Figures

METHOD AND APPARATUS FOR PRODUCTION OF CARTRIDGED PROPELLANT CHARGES FOR BARREL WEAPONS

The present invention relates to a method and an apparatus for production of cartridged propellant charges with high charge weights intended for barrel weapons, primarily artillery guns.

The range of an artillery weapon can be increased by increasing the $V_0$, i.e. the velocity at which the projectile leaves the barrel. The increase in $V_0$ can be accomplished by an increase in the weight of the charge and/or a change to more energy-rich propellant powder.

The propellant powder for barrel weapons is usually in the form of grains, flakes or strips which lie loose in a case or bag. Higher charge weights within the same limited volume can therefore be accomplished by compaction of the loose propellant powder. An increase of the energy content in the propellant charge for a given gun must however be combined with a simultaneous adaption of the burning properties of the propellant powder so that the gas pressure obtained in the gun does not exceed the maximum permissible internal pressure Pmax for the barrel and mechanism. The propellant powder can be compacted directly in the case or cartridge without the powder grains losing their character of free grains on that account. In moderate compaction the powder is therefore combusted in essentially the same manner as if it had consisted of loose powder.

A normal artillery powder has a specific weight of around 1.55 kg/liter. The charge density of charges with loose powder is usually of the order of 0.5 kg/liter. Theoretical calculations have shown that the best utilization of the powder may be expected at charge densities of around 1.1 kg/liter. In practice the best result can be obtained with a somewhat higher compaction. According to the present invention it is possible to manufacture cartridged charges of uniform quality with charge weights up to 1.4 kg/liter.

The higher the degree of compaction, the more difficult it has proved to be to manufacture charges of uniform quality giving identical firing results. Among other things it is a matter of compacting the powder grains without depriving them of their own shape. If the powder grains become partially pulverized uneven firing results are inevitably obtained. The greatest risk of being crushed is run by the powder grains located close to the wall of the case or cartridge, where they are affected by the friction against the wall of the case or cartridge, and the powder grains located uppermost in the charge and which are thus influenced directly by the piston or plunger with which the powder is forced down into the case and compacted therein.

Compaction of propellant powder for charges with high charge weights is not a completely new technique.

The technique of compacting granular propellant powder without the aid of solvents is thus prior art knowledge, for example through Swedish Patent No. 71.09803-2. The idea behind this patent is that through compaction of powder grains each of which displays a plurality of outwardly pointing arms or corners it shall be possible to manufacture powder bodies which are held together through intermeshing of the arms of the powder grains.

Another previously proposed method which has the advantage that crushing of the powder grains is avoided presupposes that these are softened up prior to compaction in a solvent vapour. The problem with this method is however that it is difficult after the compaction to expel all solvent and that residual solvent lowers the energy content of the charge at the same time as the amount of solvent may be expected to vary both within one and the same charge and between different charges and thereby give rise to an uneven quality which is also dependent upon the age of the charge. The above briefly outlined method is described in DE Offenlegungsschrift 2 403 417.

In DE Offenlegungsschrift 3 205 152 a description is presented of a multi-stage compaction where only a small amount of the propellant powder at a time is filled into the case, this partial amount being compacted by means of a drift which is inserted down into the neck of the case. No softening of the powder grains with solvent is performed in this context.

The present invention now relates to a method and an apparatus enabling granular propellant powder to be compacted without the aid of solvents in a single stage in the case or cartridge to a charge weight of up to 1.4 kg/liter. A particular advantage of the method and the apparatus according to the present invention is that pulverization of parts of the propellant powder is thereby avoided. As long as the propellant powder grains retain their identity the degree of compaction that occurs here does not appreciably influence over-ignition of the individual powder grains. Characteristic of the method according to the invention is partly that the friction between the propellant powder grains and the fixed surfaces along which the powder grains are displaced during their compaction has been minimized through a friction-decreasing coating on the surfaces and partly that the compaction is preferably performed by means of a piston or plunger with an elastically deformable leading part facing towards the propellant powder which partly brings aside for the nearest propellant powder grains and hits them from the sides instead of grinding them apart into powder during the compaction. A further advantage of the elastic plunger is that it follows the form of the compaction space as long as the change of the cross-section thereof takes place successively and is not excessively drastic. There is thus no obstacle to permitting the plunger to move down to just below the end of the neck of the case where the case commences to widen substantially. According to what has proved to be a particularly beneficial variant of the invention the powder is pressed or compacted down into the case enclosed in a bag of a combustible fibre material. As a rule it is probably then most appropriate to first place the bag in the case and then to pour in the loose propellant powder so that this fills the case and possible compaction space located outside the case whereupon all propellant powder is pressed down into the bag inserted in the case. It has namely been found that such a bag further reduces the risk of the powder grains located closest to the wall of the case becoming pulverized when all propellant powder is pressed down into the case and these powder grains must be displaced downwards in the case pressed hard against the inner wall thereof.

In the method according to the invention all propellant powder is thus pressed down into the case in one single stage. The case is then enclosed in a powerful matrix which in addition to a case seat also displays a compaction space above the neck of the case extending axially in the longitudinal direction of the case and with largely the same inside diameter as the neck of the case.

The length of the compaction space is determined by the desired compaction of the propellant powder. Both this compaction space and the case are namely filled with loosely lying propellant powder before the plunger which works largely along the compression space is inserted down into this and presses the propellant powder together so that it is all forced down into the case. It is also usually appropriate to force the plunger down a little way into the neck of the case so as to form a shoulder to insert the rear part of the shell into. A final compaction is then appropriately done in contrast directly with the shell which is then forced down the last bit into the case during final compaction of the propellant powder at the same time as a grooving press or similar device fixes the shell in the case. This last compaction performed with the shell is however very small in comparison with the compaction which takes place when the propellant powder is pressed down into the case.

By coating the surfaces along which the powder is displaced in the manner indicated above with a friction-reducing agent either directly or in the form of a bag impregnated with sliding compound pulverization of the powder grains along the said surfaces is avoided in that it is compacted and pressed down into the sleeve. A mixture of pulverized and granular powder gives rise to uneven combustion which in turn can give rise to risky pendulum pressures. To further prevent the plunger itself from pulverizing the powder grains located nearest to it it has been proposed in accordance with the variant of the invention discussed heretofore that use shall be made of a plunger with an elastically deformable leading part.

It has also been found that a still better result is obtained if the powder is compacted at an elevated temperature relative to room temperature and both case and case support, plunger and any centre pin or drift which is to make room for an ignition screw may then well be somewhat warmer than the powder itself. A powder which has been heated to approx. 70° C. and which is compacted in a 90° C. warm case thus requires at most half of the compaction force which is needed for a 20° C. powder compacted in a case at room temperature. Naturally no temperatures in the vicinity of the implosion or self-ignition temperature of the powder can be considered, nor may the temperature become so high that stabilizers included in the powder are consumed. It has thus been established that powder temperatures of between 20–90° C. are suitable for compaction of granular powder whereas surrounding parts such as case, case support, plunger and possible centre pin should not have a temperature in excess of 100° C.

Even in warm compaction the individual grains of powder retain their character of free grains but they are deformed more easily and thus adapt themselves better to one another which facilitates a raising of the degree of compaction. It has also been found that warm-compacted powder holds together better and has less tendency to crack forming.

Because powders and particularly so-called NC powders (nitrocellulose powder or single-base powder) are hygroscopic both the heating and the compaction and the cooling of the compacted powder must take place in a conditioned or closed atmosphere. This naturally involves certain complications but does not give rise to unsurmountable problems.

Because the heated powder is appreciably easier to compress the load on the grains of powder located nearest the drift appears to be so much lower that the compression, at any rate in certain cases, can be performed with a hard plunger of non-deformable material. It has also been found that the compaction of both room-temperature and heated powder is carried out more easily and with even less risk of pulverization of the powder grains if the plunger is furnished with a tapered tip facing towards the powder and preferably with a rounded top. This is regardless of whether the plunger is of elastically deformable material or not. There are no exact limit values for the angle in question but a plunger with a top angle of 30° is likely to be all too pointed and to influence to an excessive degree the powder grains in the direction towards the walls of the compression chamber instead of in a direction towards the case, whereas a top angle of approx. 160° can be expected to function roughly like a plunger with a flat front surface. Excellent results are, in contrast, obtained with a plunger with a top angle of 90°.

Before the case is filled with propellant powder certain preparations must nevertheless be made for the ignition screw of the cartridge. Either the case can be provided with a protruding pin or drift placed in the case in the location of the ignition screw which upon removal provides room for the ignition screw and offers the requisite expansion space for this or else the ignition screw can be placed in position right from the beginning and the propellant powder compacted around it. In the latter alternative a reinforced ignition screw is required capable of withstanding the strains when the powder is compacted around it. When the ignition screw is compacted into the powder the best over-ignition of the charge is probably obtained with a long ignition screw protruding into the case with a plurality of sideways-directed ignition openings.

The advantages of having the ignition screw compacted into the propellant powder become particularly noticeable in the case of cartridges which have been rammed at very high speed into the weapon cartridge seat, e.g. in A.A. guns with very high firing velocities, where not even small subsidences in the charge, e.g. in a small play around the ignition screw, can in any circumstances be accepted.

In order to obtain uniform over-ignition of even relatively firmly compacted powder special ignition arrangements are thus required, for instance in the form of a long so-called ignition screw which extends centrally along at least the main part of the length of the charge and which ignites along its entire length.

Another method which has proved to give a surprisingly uniform over-ignition is to compact the powder around a centre pin protruding into the case and screwed into the seat of the ignition screw, which pin is removed after compaction has been completed whereupon the space left behind by the centre pin when it it screwed out of the ignition screw seat and withdrawn rearwards from the case is filled with loosely powder which in turn is ignited with a conventional short ignition screw.

According to our experience the best way of minimizing the friction between the grains of propellant powder and the wall of the case and the inside of the compaction space respectively, or alternatively, between the outside of the bag and the wall of the case and the inside of the compaction space respectively, is to coat the fixed surface with a sliding lacquer. Tests with bags impregnated with sliding compound have not given the same good results throughout. The best results have been obtained by applying a teflon coating to the inside of the case and the compaction space. The teflon has then been applied with the aid of solvent but without heat.

With regard to the bag this can either be given such a form that it extends along the entire case and up along the compaction space and thus is forced upon compaction of the powder down entirely into the case together with the propellant powder or else it can be shaped so that it only fills the case and is folded down around the opening of the neck of the case. In the latter case it must be anticipated that the bag will burst along the fold, if not before then when the plunger goes down into the neck of the case. Both elaborations of the bag appear to give roughly equivalent firing results. The bag can be provided right from the beginning with a screwed-in ignition charge in the bottom. The method according to the invention also permits the charge to be produced from several different types of propellant powder which are supplied in layers or in a mixture and subsequently compacted together.

The bag itself is of an entirely conventional quality and consists of a combustible, appropriately woven textile material such as cambric.

The method and the apparatus according to the definition have been defined in the accompanying claims and will now be described in greater detail and with reference to the accompanying figures.

Figure 1:
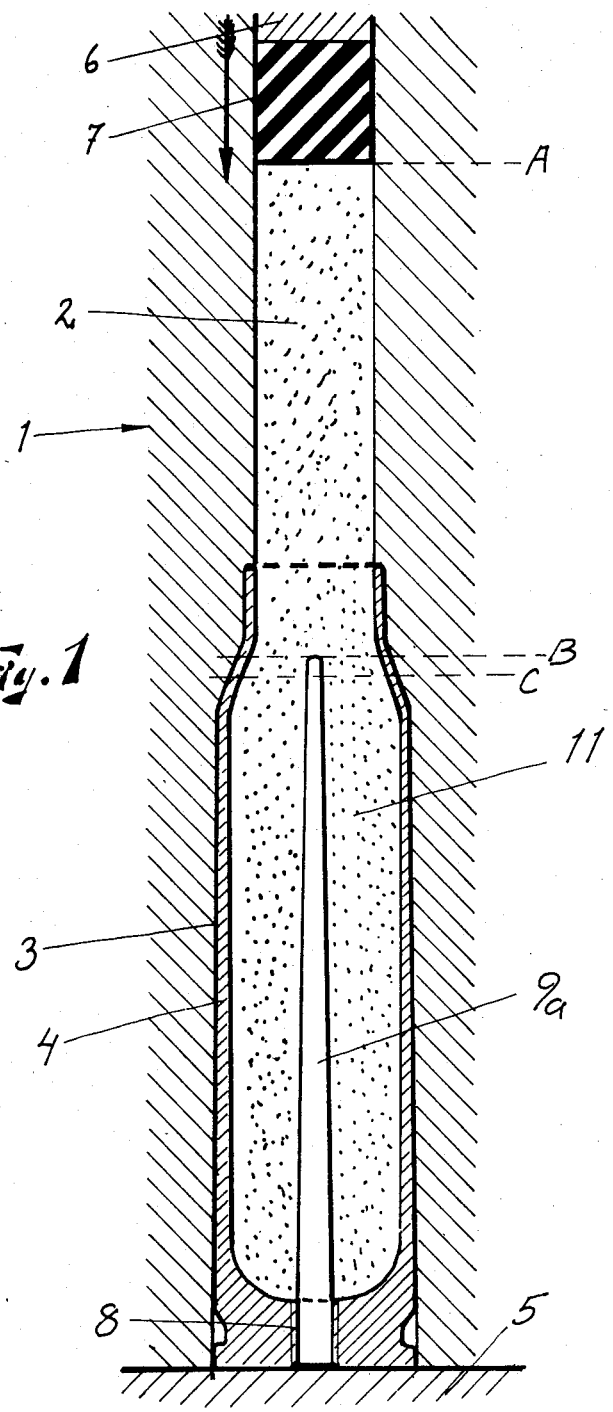
FIGS. 1–6 show a longitudinal section through different devices for performance of the invention.

Identical parts in the various figures have been given the same reference numerals. Shown in all figures is a matrix or compacting support 1 comprising a leading cylindrical compacting space 2 and a rear cartridge seat 3 disposed axially with the compaction space in which a case 4 has been applied. The case 4 is retained in place in the case seat by means of a stop or backpiece 5. Disposed in the compaction space 2 is a displaceable piston or plunger 6 with which loose propellant powder 11 which has previously been poured into both the compaction space and the case is pressed completely down into the case in one single stage. Since the end position of the plunger is given, the amount of loose propellant powder 11 filled into the compaction space 2 will determine the final degree of compaction of the charge.

The plunger 6 is made of metal but has an elastically deformable leading part 7, appropriately made of rubber with a hardness of 15–100 shore.

Figure 2:
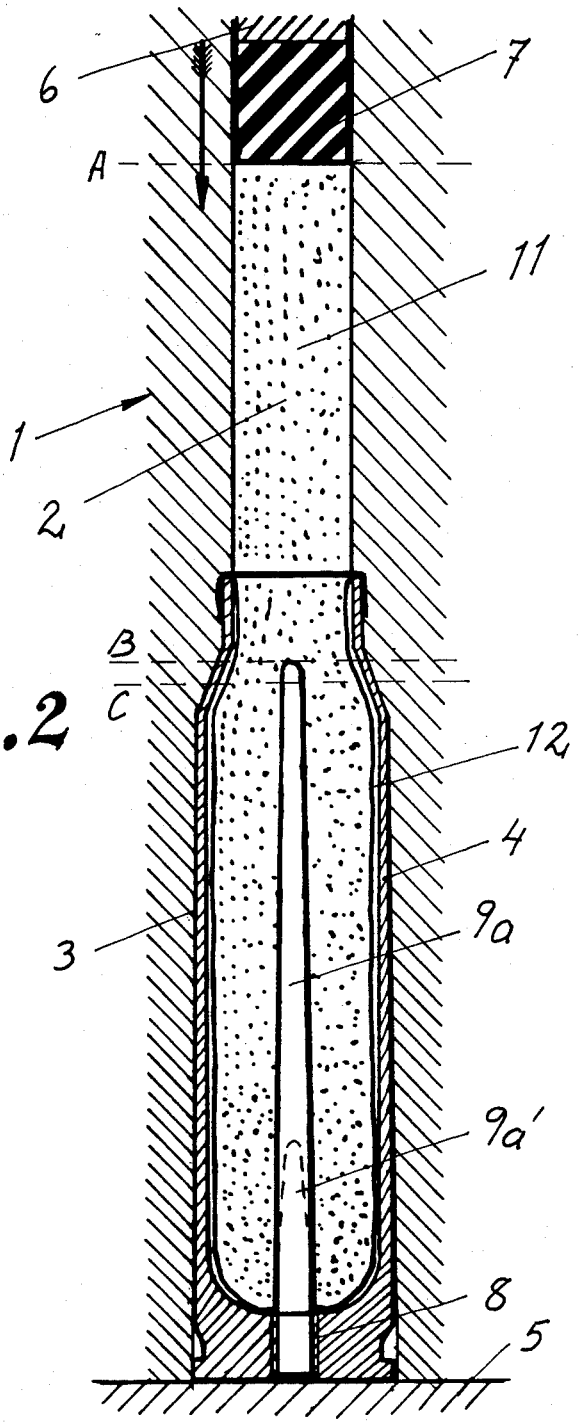
Figure 3:
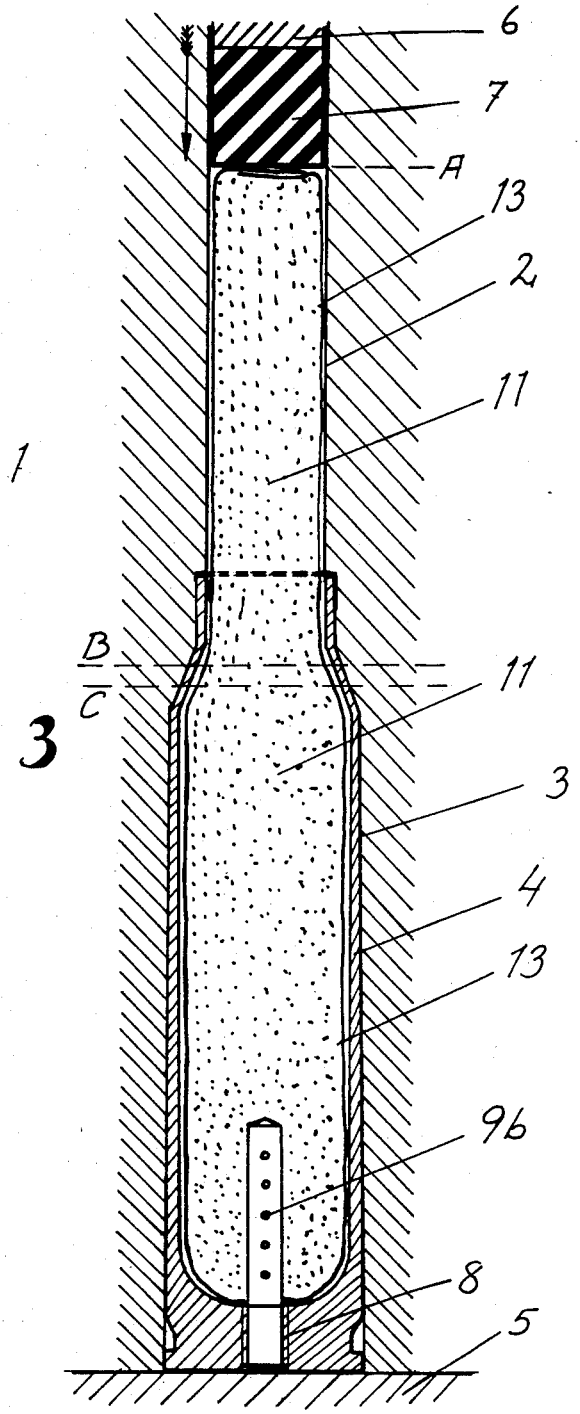
Figure 4:
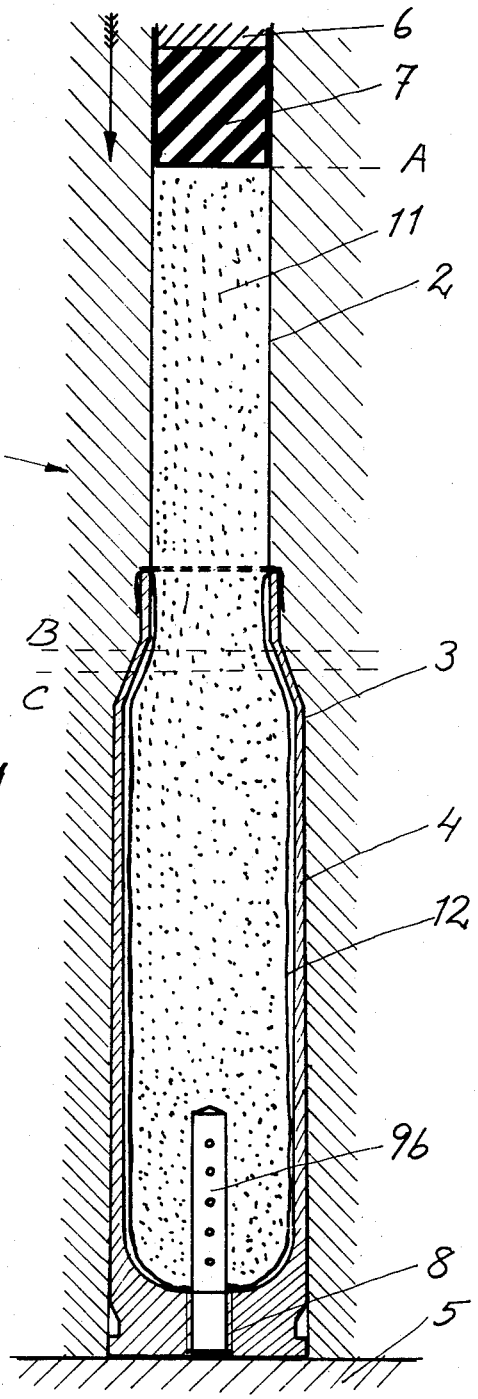
Figure 5:
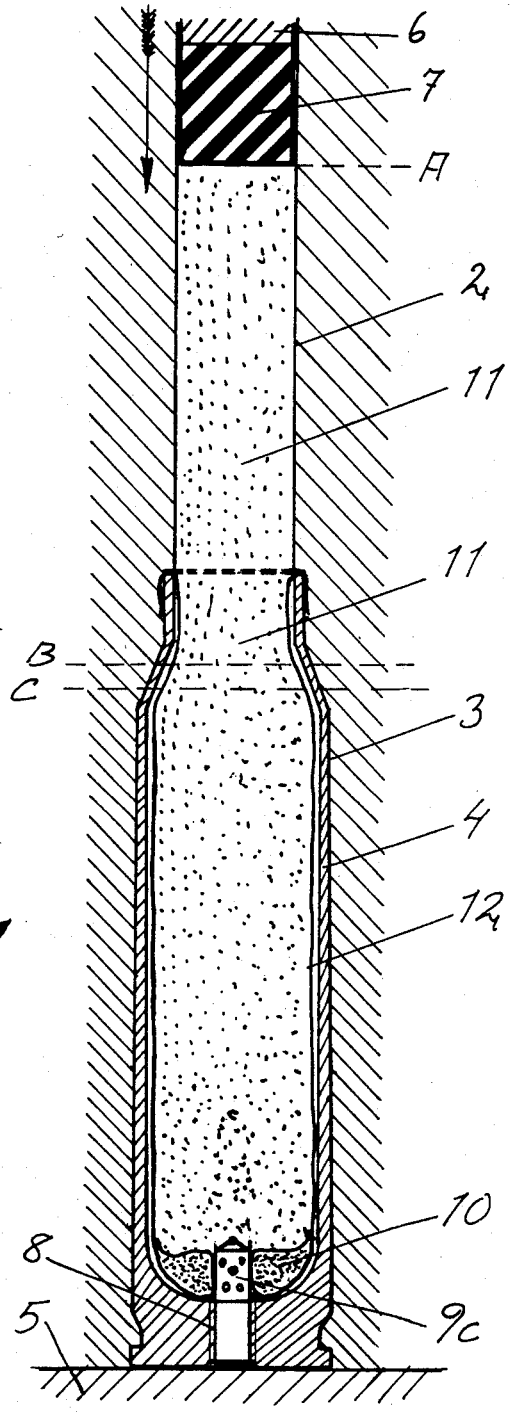

The case 4 is provided with a bottom thread 8 into which an ignition screw can be screwed. Two different types of ignition screw **9*b* and 9*c* are shown in FIG. 3–5 and are described in greater detail further on in the text. In FIG. 1 and FIG. 2, the ignition screw is replaced during the compaction of the propellant powder with a pin or drift 9*a* introduced through the bottom thread 8 of the ignition screw. Upon completion of the compaction the pin 9*a* is removed. Since the propellant powder has then become sufficiently held together the pin 9*a* will leave behind it a cavity in which the ordinary ignition screw can be mounted. Shown in FIG. 1 and FIG. 2 is a variant with a long pin 9*a*** which gives a long through-going ignition passage throughout the entire case. Either a short or a long ignition screw can be mounted optionally in this ignition passage. The whole of or parts of this ignition passage can also be filled with loosely lying ignition powder.

In FIG. 3 and FIG. 4 the case 4 is mounted with a long ignition screw **9*b*** of reinforced side-igniting type. This is compacted firm directly in the propellant powder and must therefore be so sturdy as to be capable of withstanding the stresses then arising.

In FIG. 5 the ignition screw is of a similarly reinforced but short side-igniting type. This too is compacted firm directly in the powder. In the figure it is however combined with a special ignition charge 10.

In all the alternatives shown in FIG. 1–6, the plunger 6 is displaceable from its initial position A shown in the respective figure to the second position B shaded in the figure where the leading end of the plunger has reached slightly down into the neck of the case. The position C marks the rear edge of the projectile when fitted in place. Since the plunger 6 only goes down to position B a last final compaction must take place with the projectile which is pressed down into the case at the same time as the projectile is anchored in the case e.g. by swaging of the neck of the case to the projectile with a grooving press.

As evident from the marking B in FIG. 1 and FIG. 2, the elastic leading part of the plunger 6 may very well meet the pin **9*a*. This can be permitted since the leading part 7** of the plunger is elastic and the intention of this is that the pin when it is removed shall leave behind it an ignition passage which extends along the entire case. Obviously use may also be made of a relatively short pin which only makes room for an ignition screw and in this case it will not be a matter of the pin and the plunger meeting since the length and shape of the pin is then completely adapted to the ignition screw.

A variant of a short pin is marked with a broken line in FIG. 2 under reference numeral **9*a*'. In the arrangements shown in FIG. 1–5, the inside of the compaction space and the inside of the case 4 have been coated in advance with a friction-reducing agent, for example a teflon-based sliding lacquer. In the variants shown in FIG. 2–5, use is also made of bags which have been inserted down into the cases 4 before the loose powder 5 has been filled into both the bags and the respective compaction spaces 2. The bags are of two types. A shorter bag type 12 is used according to FIGS. 2, 4 and 5. It is inserted into the case and folded around the neck of the case and held in place by the matrix 1. A longer bag type 13 is used according to FIG. 3. The bag 13 then extends along the entire compaction surface of the matrix and down into the case 4. In the case of the shorter bag type 12, the powder is pressed from the compaction space down into the bag. It must then be anticipated that the bag 12 will burst along the folder round the neck of the case, if not before then when the plunger reaches the neck of the case. In the variant of the bag 12 shown in FIG. 5 an ignition charge is sewn into the bottom of the bag. The ignition screws 9*b* and 9*c* and the pins 9*a* and 9*a*' are inserted into the bags through a special bottom hole in these. This is in order for the bags not to prevent a rapid and correct over-ignition of the propellant powder. When the longer bag type 13 according to FIG. 3 is used, the upper end of the bag is folded down after the bag has been filled with loose propellant powder whereupon both the bag and its contents of propellant powder are pressed by the plunger 6, 7 completely down into the case 4**. In consequence of the negligible friction of the bag against the walls of the compression space and of the case, which are coated with sliding lacquer, pulverization of the powder grains along the walls is avoided. In that the leading part 7 of the plunger 6 is made of an elastic material pulverization of the uppermost powder grains located nearest the plunger is also avoided. In the final analysis it is the type of propellant powder that decides if the variant according to FIG. 1, i.e. without a bag, can be used or not.

The air present between the propellant powder grains in the loosely lying powder can be diverted in several different ways in conjunction with the compaction. If a pin of type *9a, 9a'* is mounted instead of the ignition screw the air may for example be permitted to pass the side or through holes in the pin. It is also feasible to permit the air to escape past the plunger or to evacuate the air immediately before the plunger is displaced from its starting position A.

As evident from the figures, the final position for the leading part 7 of the plunger 6 is situated just below the end of the neck of the case where the case substantially commences to widen. This can be permitted since the leading elastic part of the plunger expands in pace with the space available at the time, provided that the change in area attained at any instant does not take place too rapidly or is too large.

Figure 6:
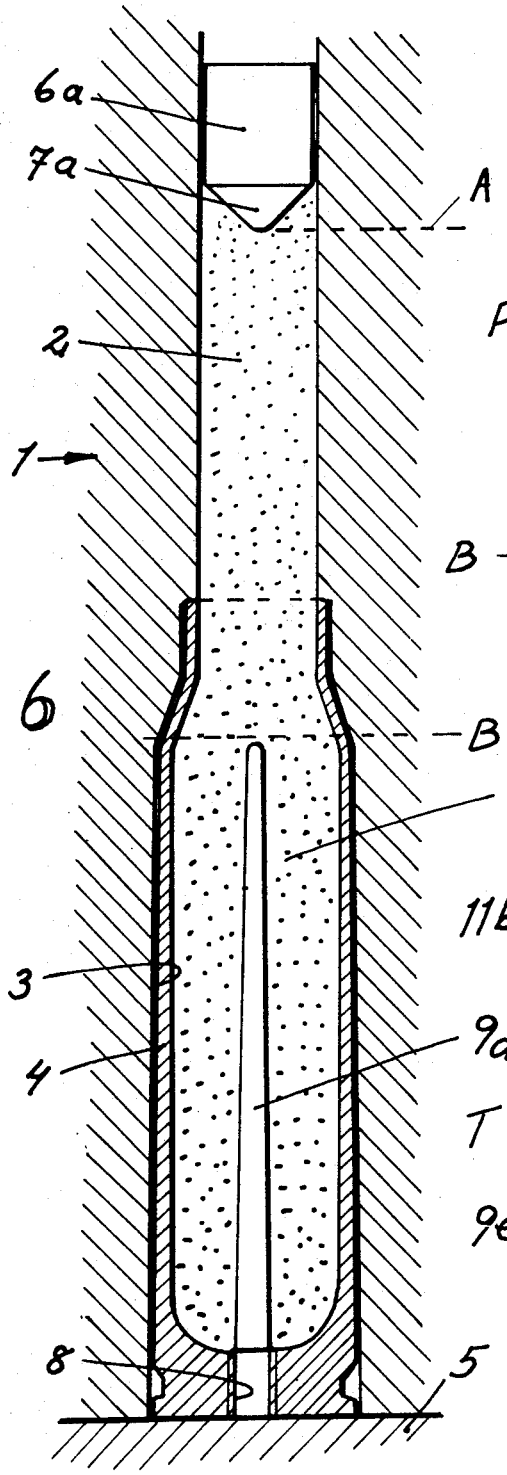

FIG. 6 shows a device suitable for compaction of powder heated to a temperature higher than room temperature. A slidable drift or plunger *6a* with a conical tip *7a* is disposed in the compaction space. The tip *7a* has a top angle of 90°. The conical tip can consist of a fixed or elastically deformable, not excessively soft material. The case 4 is provided with a bottom thread 8 for screwing in an ignition screw *9d* (FIG. 2). FIG. 1 shows a centre pin *9a* screwed into the bottom thread 8. The case 4 and the compaction space 2 are completely filled with loose powder. Both the compaction space and the inside of the case and by all means also the outside of the centre pin 9 have been coated with a friction-decreasing compound. The powder is heated to max. 90° C., whereas other parts have a temperature of max. 100° C. By driving down the plunger 6–7 from its starting position A to its stop position B all the powder is forced down into the case 4. The conical front of the plunger lowers the pressing pressure and guarantees satisfactory packing of the grains of powder, primarily in that part of the charge which is located closest to the neck of the plunger.

Figure 7:
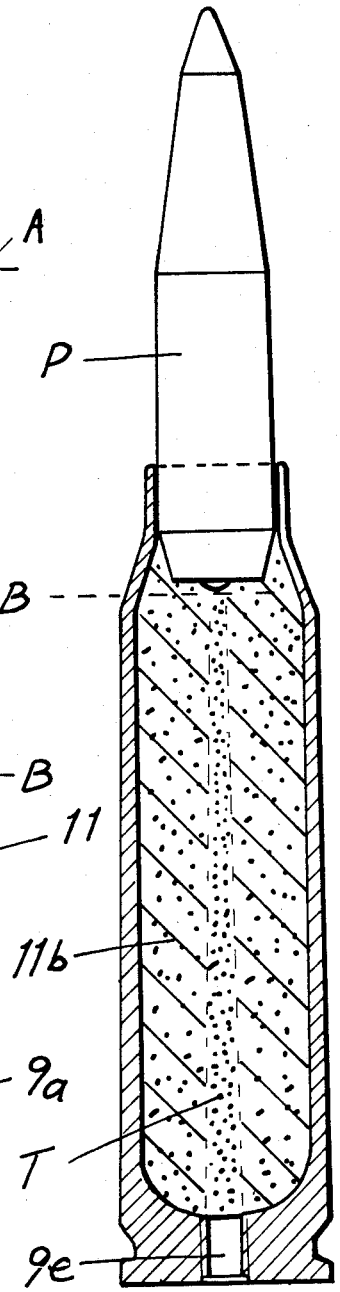
FIG. 7 shows a longitudinal section through a ready-charged cartridge. In the variants shown in FIG. 1 and FIG. 6, no bag is used whereas in the variants according to FIG. 2–5 different types of bag are used.

FIG. 7 shows the finished cartridge with the compacted powder *11b*. A projectile P has been mounted in the neck of the case. This reaches roughly equally far down into the neck of the case as the plunger 6–7 in its lowermost position. The plunger, in contrast, occupies a slightly greater volume and consequently a final compaction of the powder can take place with the projectile when this is pressed into position. The centre pin *9a* has been removed and the space which it leaves behind it in the compacted powder has been filled with loose ignition powder T and a short ignition screw *9e* has been mounted in the bottom thread 8.

We claim:

1. A method of producing cartridged propellant charges for barrel weapons with high charge densities by pressing down and compacting by means of a piston or plunger more granular or particle-shaped propellant powder into a cartridge case than said cartridge case holds of free-running propellant powder, comprising the steps of providing a cartridge case coated internally with a friction-decreasing coating pressing the entire amount of propellant powder into the coated cartridge case by means of a movable plunger in one single stage, thereby producing a compacted cartridged charge for propelling a projectile to be mounted in the neck of the case.

2. A method according to claim 1, wherein a compression space is provided outside the case, said compression space being internally coated with a friction-decreasing coating and communicating with the interior of the case and said cartridge case and said space outside the case are filled initially with free-running granular or particle-shaped propellant powder and all said propellant powder is pressed into the case by means of said plunger which is movable along said space.

3. A method according to claim 2, wherein compaction of the powder is performed by means of a plunger displaceable in the neck of the cartridge case and provided with a pointed leading end facing towards the powder.

4. A method according to claim 1 or claim 3, wherein compaction of the powder is performed with a plunger the the entire front face of of which facing towards the powder consists of an elastically deformable material.

5. A method according to claim 4, wherein the powder grains are compacted in the cartridge case at a temperature which exceeds room temperature but does not exceed 90° C.

6. A method according to claim 5, wherein the powder grains are pressed down into the cartridge case by means of a plunger which together with the said case and other elements with which the powder comes into direct contact is maintained at a temperature which exceeds the powder temperature but which does not exceed 100° C.

7. A method according to claim 5 wherein heating of the powder to compaction temperature, compaction of the power and all handling of said powder until it has again cooled to room temperature are carried out in a conditioned atmosphere with a humidity selected in advance in view of the powder and the actual temperature of enclosed vessels which are handled in such a manner that the humidity of the powder is not changed.

8. A method according to claims 1, 2 or 3, wherein a side-igniting screw for protruding in the case in an assembled condition is disposed in the case before the granular or particle-shaped propellant powder is placed therein and the propellant powder is compacted around said ignition screw.

9. A method according to claim 8, wherein a drift is mounted in the place of the ignition screw so that the drift protrudes from below into the case whereafter the propellant powder is filled in free-flowing form and compacted around the drift which is then removed in order to make room for the ignition screw and at least a certain amount of loosely filled non-compacted ignition powder.

10. A method of producing cartridged propellant charges for barrel weapons with high charge densities by pressing down and compacting by means of a piston or plunger more granular or particle-shaped propellant powder into a cartridge case than said cartridge case holds of free-running propellant powder, comprising the steps of providing a cartridge case coated internally with a friction-decreasing coating and pressing the entire amount of propellant powder into the coated cartridge case by means of a movable plunger in one single stage; wherein a bag of a combustible fibre material having coated internally a friction-decreasing coating is inserted in the cartridge case, and the granular or particle-shaped propellant powder is placed within said bag and compacted therein.

11. A method according to claim 10, wherein a bag of a combustible fibre material is inserted in both the case which is coated internally with a friction-reducing coating and the compression space which is located outside the case and thereafter both the part of the bag outside the case and the part of the bag inside the case are filled with free-running granular or particle-shaped propellant powder, and thereafter the part of the bag located outside the case with its contents of propellant powder is pressed by the plunger completely down into the case during mutual compaction of all propellant powder.

* * * * *